US005511250A

United States Patent [19]

Field et al.

[11] Patent Number: 5,511,250

[45] Date of Patent: Apr. 30, 1996

[54] ADJUSTABLE PROTECTIVE HELMET

[75] Inventors: Michael R. Field; Gregory D. Caldwell, both of Glenview, Ill.

[73] Assignee: A-Star Sports Group, Inc., Des Plaines, Ill.

[21] Appl. No.: 378,545

[22] Filed: Jan. 26, 1995

[51] Int. Cl.[6] ..... A42B 1/22

[52] U.S. Cl. ..... 2/418; 2/414; 2/425

[58] Field of Search ..... 2/410, 411, 414, 2/416, 417, 418, 419, 420, 421, 425

[56] References Cited

U.S. PATENT DOCUMENTS

| | | | |
|---|---|---|---|
| 1,725,425 | 8/1929 | Steingold | 2/183 |
| 1,894,213 | 1/1933 | Ostolaza | 2/183 |
| 2,455,797 | 12/1948 | Myers et al. | 2/6 |
| 2,739,310 | 3/1956 | Frieder et al. | 2/410 |
| 3,600,713 | 7/1969 | Holt | 2/410 |
| 4,713,844 | 12/1987 | Westgate | 2/411 |
| 5,012,533 | 5/1991 | Raffler | 2/420 |
| 5,142,705 | 9/1992 | Edwards | 2/418 |
| 5,315,718 | 5/1994 | Barson et al. | 2/418 |
| 5,381,560 | 1/1995 | Halstead | 2/421 |

FOREIGN PATENT DOCUMENTS

| | | | |
|---|---|---|---|
| 280042 | 8/1988 | European Pat. Off. | 2/417 |

*Primary Examiner*—Michael A. Neas
*Attorney, Agent, or Firm*—Charles F. Lind

[57] ABSTRACT

An adjustable protective helmet having a substantially rigid outer bowl-shaped shell sized larger that the user's head, and having inner padding inside of the shell sized to fit on the user's head but with a looser fit than desired. The adjustment structure includes a flexible strap extended through circumferentially spaced slots in the shell to extend both inside of and outside of the shell, to its ends outside of the shell sized to overlap one another. A rivet secures the underlying strap end to the shell. The padding between the shell slots is free from connection with the shell, and the strap in this region overlies the padding between the padding and shell and is secured to the padding. Quick release fastening pads on the overlapping strap ends allow them to be releasibly secured together. The strap can thus be tightened via the overlying strap end from outside of the shell and connected to the underlying strap end to establish the helmet fit desired.

7 Claims, 3 Drawing Sheets

ADJUSTABLE PROTECTIVE HELMET

BACKGROUND OF THE INVENTION

Protective headgear is used in many daily efforts to overlie and partly cover and shield one's head. This includes different types of protective headgear or helmets used for most sports, including specifically baseball batter's helmets, in-line skating helmets, hockey helmets, lacrosse helmets, as well as hard hats and work or construction helmets.

Such protective helmets commonly utilize a hard outer somewhat bowl-shaped shell sized sufficiently large to fit over the top and part of the sides of the user's head, and an inner padding or straping that fits snug against the head and holds the shell spaced from the head.

A major drawback of such headgear is improper fit of the helmet on the user's head, generally being too loose and allowing excessive helmet movement on the head. This is expected as standard sizes are available, and the intention is to have a selected standard size fit many different users, such as a single batter's helmet to be used only when actually batting.

Many helmets further have head band or strap arrangements inside of the shell and frequently inwardly of the padding to lie directly against the user's head. Minor size differences of the helmet needed for a firm or tight fit on the head frequently can be made by adjustment of the inner padding, head band or straping. However, such adjustments must be made from inside of the helmet, making such difficult to do, whereby it is typically not the practice of adjusting the helmet size when only a minor change is needed; instead, nor loose fits probably are the norm rather than the exception.

SUMMARY OF THE INVENTION

This invention relates to protective headgear or helmets that can be expected to be used by many different users, with the expected wide variety of head sizes, where a form of size adjustment is provided to provide broad but yet effective helmet usage.

A basis object of this invention is to provide on protective headgear or helmets suitable forms of size adjustment structure that can be quickly and easily used, from the outside of the helmet and even when on the head of the user, to offer a snug effective helmet fit on many different head sizes and shapes.

Other objects of this invention are to provide adjustment structure that is low in cost; that is easy to use, even by the very young (six year baseball players, for example); and that can be adjusted by the user with the helmet positioned on the user's head, to yield a proper snug fit and effective user protection.

BRIEF DESCRIPTION OF THE DRAWINGS

These and other objects, features or advantages of the invention will be more fully understood and appreciated after consideration of the following description of the invention, which includes as a part thereof the accompanying drawings, wherein.

DETAILED DESCRIPTION OF PREFERRED EMBODIMENTS OF THE INVENTION

Figure 1:
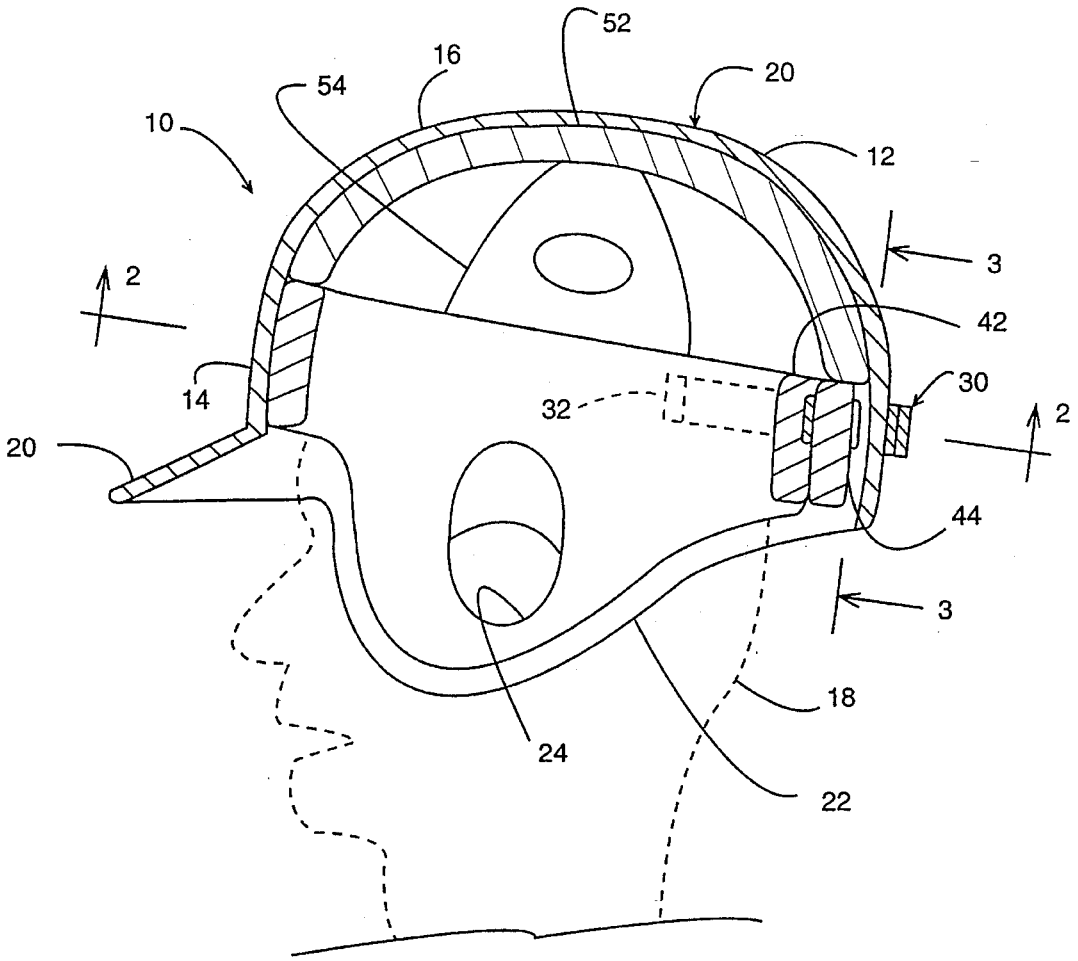
FIG. 1 is a side elevational view, partly broken away and in section for clarity of disclosure, of a typical baseball helmet having a preferred embodiment of the invention incorporated therein, and showing in phantom a player's head properly fitted within the helmet.
Figure 2:
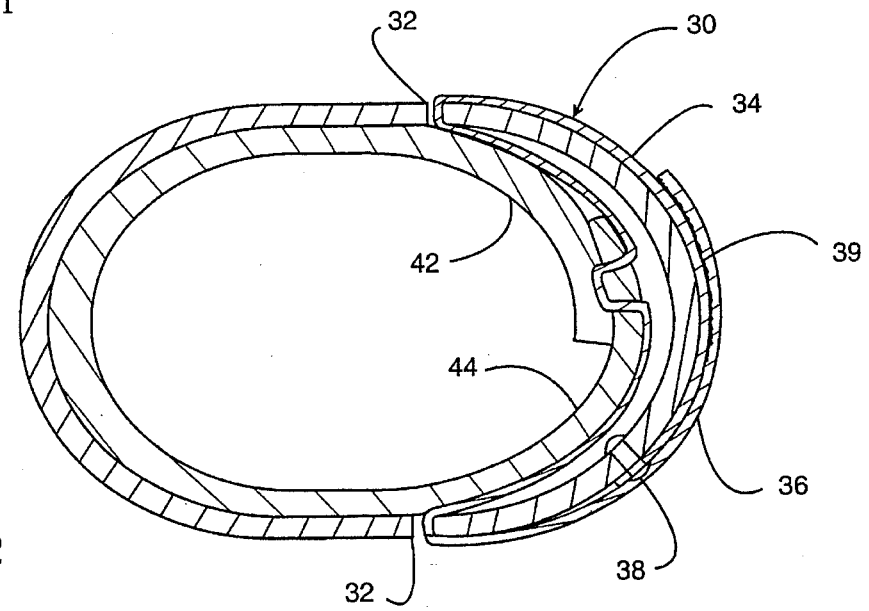
FIG. 2 is a sectional view taken generally from line 2—2 in FIG. 1.
Figure 3:
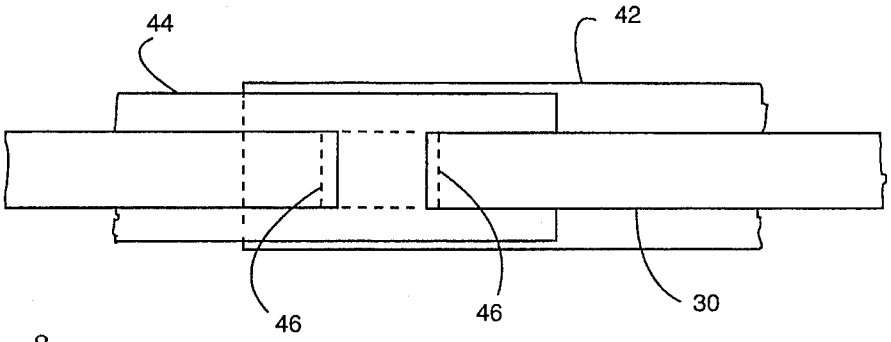
FIG. 3 is an enlarged rear elevational view, taken somewhat from line 3—3 in FIG. 1, but of the inner padding and adjustment strap only and not of the helmet shell.

The invention is disclosed herein embodied in a baseball batter's protective headgear or baseball helmet 10 having a substantially rigid outer bowl-shaped shell 12 comprised with a generally continuous or circumferential side wall 14 and with a cross or top wall 16 blended off of the side wall closing the shell top. The helmet shell 12 is sized both laterally and longitudinally larger that the head 18 (shown in phantom) of its intended user, so that it can fit loosely on and telescope partly over the user's head while yet being spaced therefrom. Inner padding 20 is contained inside of the shell 12, to fit normally between the shell and the user's head.

In the helmet illustrated, the shell side wall 14 is extended downwardly in the front to approximately the top of the user's forehead, to a forwardly projected front visor 20 intended to overlie the user's eyes, and is extended downwardly on the sides 22 to cover the user's temple areas and ears, with an appropriately aligned ear hole 24.

Ideally, the inner padding 20 will fit between the shell and the user's head 18, snuggly against the user's head, and hold the shell spaced from the head, at its front, sides and rear, and over its top. However, unless the helmet 10 is specifically sized for the user's head, the padding 20 more commonly will be larger than the user's head, whereby the helmet will fit loosely on the head and some radial clearance will exist between the padding and head.

The invention helps to achieve the ideal sizing goal for a properly fitted helmet, and is easily implemented. Thus, an adjustment strap 30 is extended through slots 32 in the side wall, across the inside of the helmet, and then around part of the outside of the helmet to ends 34 and 36 that overlap in the region between the shell slots 32 as underlying and overlying layers, thereby forming an endless loop. The underlying strap end 34 is secured to the shell, as by rivet 38. Cooperating hook-loop fastening pads 39 (for example Velcro fasteners) are secured on the overlapped strap ends to allow the easy, fast but positive and releasible connection of the strap ends together, at virtually infinitally adjustable variations.

The shell side wall is curved and the shell slots 32 are at circumferentially spaced locations in the shell side wall, so that when the strap 30 is tightened without a user's head in the helmet, it can be drawn straight across, and between its mountings at the shell slots, for determining the smallest helmet adjustment. On the other hand, a totally loosened strap in the region between the shell slots 32 can be biased outwardly until it is constrained against the inside of the shell. With a user's head in the helmet, strap tightening will shift it inwardly from the shell side wall until it firms the adjacent padding against the user's head or it reaches the smallest helmet adjustment setting. The strap thus spans between its mountings at the shell slots in the side wall, and serves to hold the head spaced from the shell side wall between these mountings.

Figure 4:
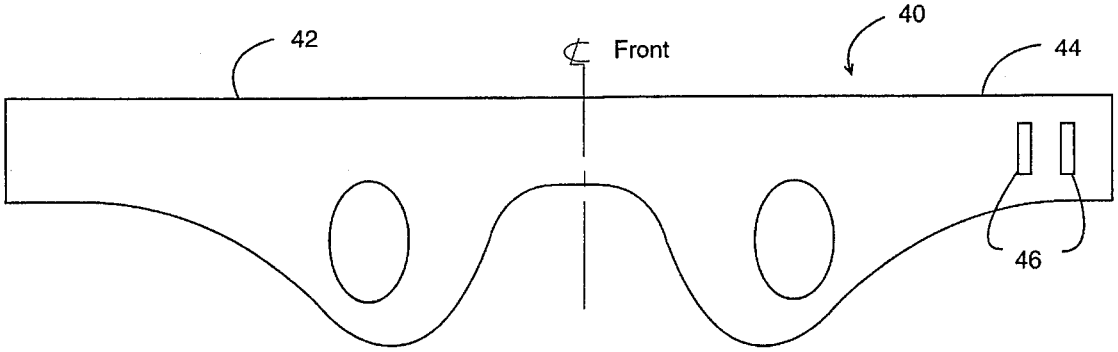
FIGS. 4 and 5 are flat development views of multiple piece inner padding suitable for use in the helmet of the previous figures.
Figure 5:
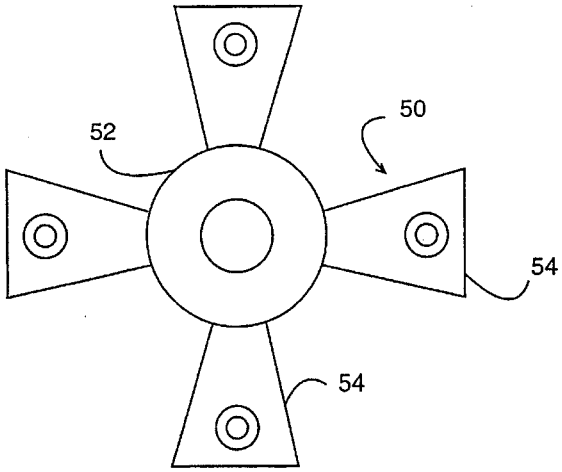

The padding 20 preferably could be formed of multiple pieces, such as illustrated in FIGS. 4 and 5, including a band member 40 that can be curved to fit inside the shell, with opposite ends 42 and 44 that overlap as inner and outer layers in the region between the shell slots 32. The padding band 40 thus generally encircles the user's head. Other than at the overlapped ends 42 and 44, the padding member 40 can be secured to the inside of the shell by cooperating hook-loop fastening pads, for example Velcro fasteners (not shown). The strap 30 inside the shell and between the slots 32 is connected to the outer padding layer 44, as by being looped through circumferentially spaced slots 46 therein, while primarily being on the remote side of the padding from the head and being between the padding and shell side wall.

The padding 20 could further include a top portion 50 having a crown member 52 and finger members 54 that would extend to close proximity of the band member 40. These padding members also can be secured to the inside of the shell by cooperating hook-loop fastening pads (not shown).

It can readily be appreciated that every helmet user can make size adjustments, even minor adjustments and while wearing the helmet, merely by releasing the overlying strap end 36 and then pulling it away from the shell to tension the strap inside the helmet and shift it and the padding against the user's head to the degree of tightness desired. When this helmet fit and size is obtained, it can be permanently set merely by closing the overlying strap end 36 against the underlying strap end 34 and locking the fasteners 39. Moreover, the suspension of the padding spaced from the shell side wall, by the tensioned adjustment strap, might well increase the shock absorbing and safety of the helmet.

While a strap without appreciable elasticity or stretching will work, it is preferred to use a strap with some but limited elasticity or stretching. This allows slight size yielding of the padding against the user's head during actual helmet use, while yet firmly holds the helmet relative to the user's head, and appears to improve user comfort.

Figure 6:
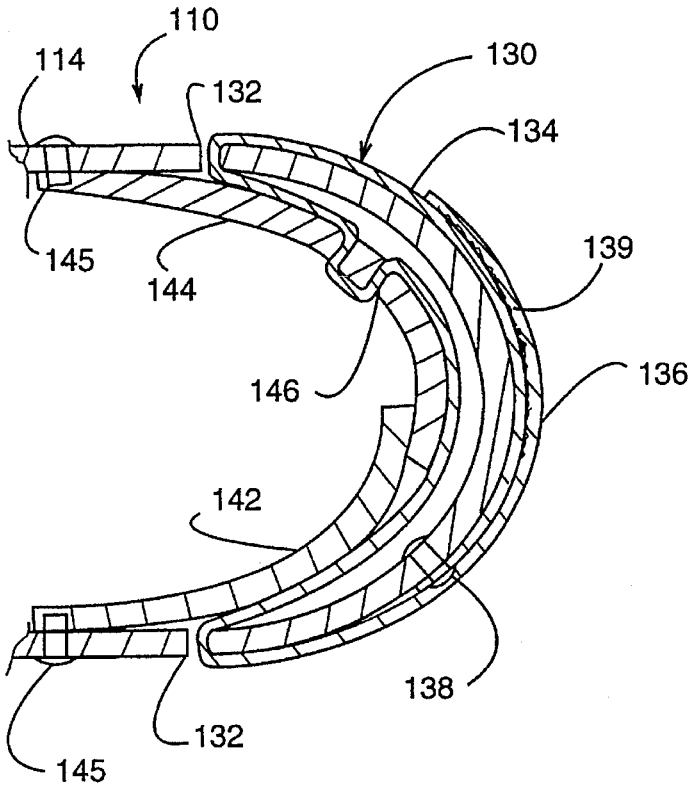
FIG. 6 is a bottom view, similar to FIG. 2, but of another helmet embodiment having the invention incorporated therein.

FIG. 6 illustrates an alternative helmet adjustment structure for a helmet 110 having side wall 114, utilizing adjustment strap 130 extended through circumferentially spaced slots in the shell side wall and extended across the helmet inside and around part of the helmet outside to underlying and overlying ends 134 and 136 in the region between the shell slots. The underlying strap end 134 is secured to the shell by rivet 138, and cooperating hook-loop fastening pads 139 secured on the overlapped strap ends allow the releasible connection of the strap ends together. Separate padding members are used, with their ends 142 and 144 overlapping as inner and outer layers in the region between the shell slots 132. The opposite ends of the padding members are secured to the shell side wall at connections 145 spaced circumferentially from the strap mounting slots. Appropriate forms of padding or interior straping can be used on the remainder of the helmet shell not illustrated. Other than at the connections 145, the padding members are free to be shifted relative to the inside of the shell. The strap 130 inside the shell and spanned between its mountings at the slots 132 is coupled to the outer padding layer 144, as by being looped through circumferentially spaced slots 146 therein.

Figure 7:
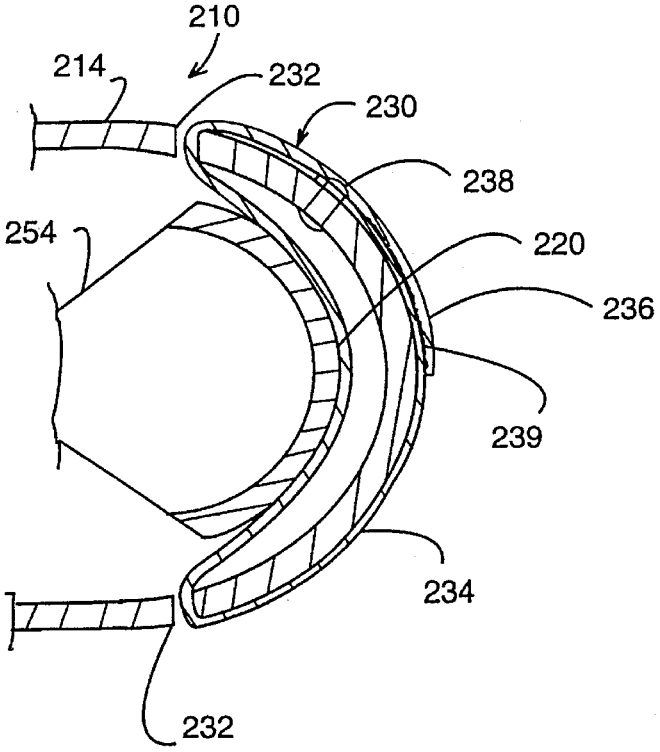
FIG. 7 is a bottom or inside view, similar to FIGS. 2, but of yet a third helmet embodiment having the invention incorporated therein.

FIG. 7 illustrates yet another adjustment structure for helmet 210 having side wall 214, utilizing adjustment strap 230 extended through circumferentially spaced slots 232 in the side wall and extended across the helmet inside and around part of the helmet outside to underlying and overlying ends 234 and 236 in the region between the shell slots. The underlying strap end 234 is secured to the shell at connection 238, and cooperating hook-loop fastening pads 239 are secured on the overlapped strap ends to allow for releasibly connecting the overlying strap end relative to the helmet shell, at adjustable positions. The padding 220 includes a single member free in the region between the shell slots 232 from connection to the inside of the shell, but may have an extension 254 upward in the direction transverse to the extended strap and toward the helmet crown (similar to crown 52 and finger 54 of FIG. 5), and the padding extension could be secured as by hook-loop fastenters (not shown) to the shell in a region spaced from the strap. The strap 230 inside the shell and between the slots 232 is connected to the padding member, as by hook-loop fastenters 239, overlying the outside face of the padding.

The adjustment structures of FIGS. 6 and 7 operate in a related manner to that already discussed, in that the adjustment strap and padding can be moved inwardly away from the shell side wall and toward the user's head in the helmet to establish the size and tightness of fit desired.

Although the different adjustment structures were each illustrated at the rear of the helmet disclosures, and only one such structure was illustrated on any helmet, the location and/or number of such adjustment structure(s) could be modified, depending on the precision of adjustment needed and the product costs that can be accepted. Also, the helmet shell between the shell slots or strap mountings relative to the helmet is curved and the term circumferentially spaced is used in the disclosure to signify this curvature (referenced at the curved head band region of the helmet), although the curvature need not be uniform or about a single center. Nonetheless, the approximate radius of curvature of the helmet shell and the included arc separation between the shell slots for the strap determine the actual maximum size adjustment that can be provided. Practical arc separations would be between approximately 45 and 180 degrees, the latter providing that the slot connections are located generally diametrically opposite one another. Further, the term circumferentially would cover an adjustment strap being extended across the top or crown region of the helmet, to overlie the top of the user's head and adjust the depth of head insertion into the helmet.

Further, while the helmet preferably has an inner padding to help cushion any blows applied against the exterior of the helmet from reaching the user's head, the padding could be eliminated while yet having the inventive strap arrangement improve the overall effectiveness of the helmet, by allowing accurate helmet size adjustment and proper helmet fit. Thus, the disclosed strap arrangement can provide quick tightening of the strap band inside of the helmet via the exterior strap end from outside of the shell, for snugging the inside strap as desired.

While specific embodiments have been illustrated, it will be obvious that minor changes could be made therefrom without departing from the spirit of the invention. Accordingly, the invention is to determined by the scope of the following claims.

What is claimed is:

1. An adjustable protective helmet, comprising the combination of a substantially rigid outer bowl-shaped shell having a side wall sized both laterally and longitudinally larger that the user's head adapted thereby to fit loosely thereon and yet be spaced therefrom;

inner padding fitted inside of the shell adjacent the side wall and sized to fit on the user's head while yet providing a looser head-helmet fit than desired;

adjustment structure including a flexible strap extended through circumferentially spaced slots in the shell side wall, said strap being extended inside of the shell next to the shell side wall between such slots, with the strap being extended therethrough to outside of the shell as underlying and overlying ends, means securing the underlying strap end relative to the shell side wall, said padding between the shell slots being free from connection with the shell side wall and the strap in this region overlying the padding between the padding and shell side wall and means couplng the strap and padding together, and means to releasibly secure the overlying strap end relative to underlying strap end, whereby tightening the strap via the overlying strap end from outside of the shell effectively snugs the padding against the user's head to establish the fit desired.

2. An adjustable protective helmet according to claim 1, further wherein said stray having limited elasticity, and said shell slots being circumferentially spaced apart across an included arc of curvature of the order between 45 and 180 degrees.

3. An adjustable protective helmet, comprising the combination of a substantially rigid outer bowl-shaped shell having a side wall sized both laterally and longitudinally larger that the user's head adapted thereby to fit loosely thereon and yet be spaced therefrom;

inner padding fitted inside of the shell adjacent the side wall and sized to fit on the user's head while yet providing a looser head-helmet fit than desired;

adjustment structure including a flexible strap and mounting means at circumferentially spaced locations in the shell side wall, said strap being extended inside of the shell next to the shell side wall between such mounting means, at least one of the mounting means being a slot in the shell with the strap being extended therethrough to one strap end outside of the shell, means securing the other strap end relative to the shell side wall, said padding between the strap mounting means being free from connection with the shell side wall and the strap in this region overlying the padding between the padding and shell side wall and the strap and padding being coupled together in this region, means to releasibly secure the one strap end relative to the outside of the shell, whereby tightening the strap via the one strap end from outside of the shell effectively snugs the padding against the user's head to establish the fit desired, and said padding between the strap mounting means including overlapping inner and outer layers, and said securing means operating to secure the strap relative to only the outer padding layer.

4. An adjustable protective helmet, comprising the combination of a substantially rigid outer bowl-shaped shell having a side wall sized both laterally and longitudinally larger that the user's head adapted thereby to fit loosely thereon and yet be spaced therefrom;

inner padding fitted inside of the shell adjacent the side wall and sized to fit on the user's head while yet providing a looser head-helmet fit than desired;

adjustment structure including– a flexible strap and mounting means at circumferentially spaced locations in the shell side wall, said strap being extended inside of the shell next to the shell side wall between such mounting means, at least one of the mounting means being a slot in the shell with the strap being extended therethrough to one strap end outside of the shell, means securing the other strap end relative to the shell side wall, said padding between the strap mounting means being free from connection with the shell side wall and the strap in this region overlying the padding between the padding and shell side wall and the strap and padding being coupled together in this region, means to releasibly secure the one strap end relative to the outside of the shell, whereby tightening the strap via the one strap end from outside of the shell effectively snugs the padding against the user's head to establish the fit desired, and said padding extending circumferentially beyond the strap mounting means and said padding and shell in this region being secured together.

5. An adjustable protective helmet, comprising the combination of a substantially rigid outer bowl-shaped shell having a side wall sized both laterally and longitudinally larger that the user's head adapted thereby to fit loosely thereon and yet be spaced therefrom;

inner padding fitted inside of the shell adjacent the side wall and sized to fit on the user's head while yet providing a looser head-helmet fit than desired;

adjustment structure including a flexible strap and mounting means at circumferentially spaced locations in the shell side wall, said strap being extended inside of the shell next to the shell side wall between such mounting means, at least one of the mounting means being a slot in the shell with the strap being extended therethrough to one strap end outside of the shell, means securing the other strap end relative to the shell side wall, said padding between the strap mounting means being free from connection with the shell side wall and the strap in this region overlying the padding between the padding and shell side wall and the strap and padding being coupled together in this region, means to releasibly secure the one strap end relative to the outside of the shell, whereby tightening the strap via the one strap end from outside of the shell effectively snugs the padding against the user's head to establish the fit desired, and said padding having an unitary extension disposed transversely away from the strap and said padding and shell in this region spaced from the strap being secured together.

6. An adjustable protective helmet according to claim 5, comprising said strap lying adjacent the bottom of the shell, and said unitary padding extension being disposed toward the top of the shell and said padding and shell being secured together in this top region spaced from the strap.

7. An adjustable protective helmet according to claim 5, comprising said strap lying adjacent the rear of the shell, said mounting means being disposed at circumferential locations spaced toward the front of the shell, and said unitary padding extension being disposed toward the top of the shell and said padding and shell being secured together in this top region spaced from the strap.

* * * * *